US012781999B2

(12) United States Patent
Machui et al.

(10) Patent No.: US 12,781,999 B2
(45) Date of Patent: Nov. 3, 2026

(54) HOT WATER HEATING DEVICE

(71) Applicant: BRITA SE, Taunusstein (DE)

(72) Inventors: Oliver Machui, Bad Homburg (DE); Ralph Maier, Kronberg (DE); Matthias Hensel, Hanau (DE)

(73) Assignee: BRITA SE, Taunusstein (DE)

( * ) Notice: Subject to any disclaimer, the term of this patent is extended or adjusted under 35 U.S.C. 154(b) by 637 days.

(21) Appl. No.: 18/549,738

(22) PCT Filed: Feb. 22, 2022

(86) PCT No.: PCT/EP2022/054334
§ 371 (c)(1),
(2) Date: Sep. 8, 2023

(87) PCT Pub. No.: WO2022/194496
PCT Pub. Date: Sep. 22, 2022

(65) Prior Publication Data

US 2024/0151432 A1 May 9, 2024

(30) Foreign Application Priority Data

Mar. 18, 2021 (EP) ..... 21163341

(51) Int. Cl.
*F24H 1/20* (2022.01)
*F24H 4/04* (2006.01)
*F24H 9/00* (2022.01)

(52) U.S. Cl.
CPC ..... *F24H 1/202* (2013.01); *F24H 4/04* (2013.01); *F24H 9/0015* (2013.01)

(58) Field of Classification Search
CPC . F24H 1/20; F24H 1/201; F24H 1/202; F24H 1/22; F24H 1/125; F24H 1/48;
(Continued)

(56) References Cited

U.S. PATENT DOCUMENTS 2,784,291 A * 3/1957 Harney ..... F24H 9/0021 392/452
2012/0051724 A1* 3/2012 Abraham ..... F24H 1/122 392/441
2021/0052106 A1* 2/2021 Mckay ..... F25B 29/003

FOREIGN PATENT DOCUMENTS

CA 1117833 A 2/1982
CN 202112923 U 1/2012
(Continued)

OTHER PUBLICATIONS

Chinese Office Action dated Mar. 25, 2026 for corresponding Chinese Application 202280017708.0.

*Primary Examiner* — Sang Y Paik
(74) *Attorney, Agent, or Firm* — Hudak, Shunk & Farine Co. LPA

(57) ABSTRACT

A hot water heating device includes a heating chamber with a water inlet for feeding water into the heating chamber and with a water outlet for removing hot water from the heating chamber. The water outlet includes an outlet duct with a suction opening arranged within the heating chamber at a distance to a bottom of the heating chamber and facing a top side opposite of the bottom of the heating chamber. The hot water heating device further includes a heating element arranged within the heating chamber for heating the water within the heating chamber. The water outlet further includes a steam bubble retention device that forms a water intake duct that runs into the suction opening of the water outlet and that prevents steam bubbles to flow through the suction opening of the outlet duct. The steam bubble retention device includes an intake duct with an intake opening and with a muzzle opening that runs into the suction opening of the outlet duct, whereby a cross-sectional area of the intake opening of the intake duct is larger than the cross-sectional area of the suction opening of the outlet duct.

14 Claims, 4 Drawing Sheets

(58) Field of Classification Search
CPC . F24H 1/50; F24H 4/04; F24H 9/0015; F24H 9/133
USPC ..... 392/441, 447, 451, 452
See application file for complete search history.

(56) References Cited

FOREIGN PATENT DOCUMENTS

| | | | |
|---|---|---|---|
| CN | 202531492 | U | 11/2012 |
| CN | 102905589 | A | 1/2013 |
| CN | 207755053 | U | 8/2018 |
| CN | 209750751 | U | 12/2019 |
| CN | 210405678 | U | 4/2020 |
| CN | 111840050 | A | 10/2020 |
| DE | 3012590 | A1 | 1/1982 |
| DE | 202007006907 | U1 | 9/2007 |
| GB | 451327 | A | 8/1936 |
| JP | 2001070158 | A | 3/2001 |
| JP | 2002051910 | A | 2/2002 |
| JP | 2002102063 | A | 4/2002 |
| JP | 2004183990 | A | 7/2004 |
| JP | 2005230485 | A | 9/2005 |
| JP | 5969723 | B1 | 8/2016 |
| WO | 2010065985 | A1 | 6/2010 |

* cited by examiner

HOT WATER HEATING DEVICE

FIELD OF THE INVENTION

The invention relates to a hot water heating device comprising a heating chamber with a water inlet for feeding unheated water into the heating chamber and with a water outlet for removing hot water from the heating chamber, whereby the water outlet comprises an outlet duct with a suction opening arranged within the heating chamber at a distance to a bottom of the heating chamber and facing a top side opposite of the bottom of the heating chamber, the hot water heating device further comprising a heating element arranged within the heating chamber for heating the water within the heating chamber.

BACKGROUND OF THE INVENTION

Such a hot water heating device is commonly named as a boiler and used for providing hot water within a building, whereby the hot water heating device is fed from a cold water supply, usually from a common water supply system. The hot water heating device only requires a power supply for the heating element that is mounted within the heating chamber. A stationary hot water heating device is usually permanently connected to a water reservoir, usually the water supply system installed within a building. A transportable hot water heating device can be manually filled with cold water that will be heated and stored within the heating chamber of the hot water heating device until the hot water is removed from the hot water heating device.

The heating element of many hot water devices is located near the bottom of the heating chamber. Thus, the full heating capacity will be available also if the heating chamber is only partially filled by water, as long as the heating element is completely surrounded by the amount of water that is stored within the heating chamber. Furthermore, the heated water rises to the top of the heating chamber, and the cooler water collects at the bottom.

The heated water will be removed from the heating chamber through an outlet duct with a suction opening that is positioned at a distance to a bottom of the heating chamber in order to favor the withdrawal of hot water, which accumulates in an upper area, and to avoid the withdrawal of cooler water as well as to avoid the withdrawal of limescale and other unwanted particles like rust or dirt, which accumulates in a lower area of the heating chamber. Thus, the position of the suction opening of the outlet duct is usually located near the bottom of the heating chamber, but above or within the height range of the heating element.

However, operating the heating element also generates small steam bubbles. Due to the buoyancy of the steam bubbles, they also rise to the top of the heating chamber. The small steam bubbles are mobile within the water inside the heating chamber and usually rise slowly to the top of the heating chamber until they break through the water surface that depends on the filling level of water within the heating chamber.

If there is a withdrawal of water from the heating chamber, an amount of water will be drained through the water outlet, resulting in a suction flow of water that flows through the suction opening and through the outlet duct until the water is dispensed by an outlet opening of the water outlet. If the steam bubbles pass along the suction opening of the outlet duct and water is sucked through the suction opening into the outlet duct, many of these steam bubbles will also be sucked into the outlet duct and will be entrained by the flow of water through the outlet duct.

Many hot water heating devices also comprise a pump that is arranged outside the heating chamber along the outlet duct. During operation the pump generates a suction effect that sucks water from the heating chamber through the suction opening into the outlet duct in order to discharge the water through the outlet opening. If steam bubbles are carried along with the flow of water through the outlet duct, the steam bubbles will accumulate within the pump and the increasing amount of steam inside the pump will reduce the suction efficiency of the pump.

Accordingly, there is a need for a hot water heating device that reduces the amount of steam bubbles that will be sucked into the outlet duct during a heating period of the heating element.

SUMMARY OF THE INVENTION

The present invention relates to a hot water heating device as described above, whereby the water outlet further comprises an steam bubble retention device that forms a water intake duct that runs into the suction opening of the water outlet and that prevents steam bubbles to flow through the suction opening of the outlet duct. The steam bubble retention device can be designed to redirect the suction flow and thus to avoid the suction of water through the suction opening that comprises a large amount of steam bubbles. By separating the suction volume for the intake of water that will be removed from the heating chamber from the region of accumulated steam bubbles, i.e. from the region above the heating element, the number of steam bubbles that will be sucked into the outlet duct can be significantly reduced. It is also possible to reduce the flow velocity of the suction flow that flows through the suction opening, which will allow many steam bubbles to escape from the suction flow and to continue to rise to the top of the heating chamber. If the flow velocity of the suction flow is smaller than the ascent velocity of the steam bubbles, most or all steam bubbles will continue to rise to the top and the intake of steam bubbles into the outlet duct will be very small or zero.

The steam bubble retention device can be manufactured separately and mounted on top of the outlet duct. The steam bubble retention device can be form-fitted or force-fitted to the outlet duct. In case that the material of the steam bubble retention device is identical to the material of the outlet duct, or if there is a suitable match of materials, the steam bubble retention device can be material-fit to the outlet duct. It is also possible to form the steam bubble retention device in one piece with the outlet duct.

According to an advantageous aspect of the invention, the steam bubble retention device comprises an intake duct with an intake opening and with a muzzle opening that runs into the suction opening of the outlet duct, whereby a cross-sectional area of the intake opening of the intake duct is larger than the cross-sectional area of the suction opening of the outlet duct. The flow velocity of a water flow through a duct with decreasing cross-sectional area of the duct increases. Thus, due to the cross-sectional area of the intake opening being larger than the cross-sectional area of the suction opening, the flow velocity of the suction flow through the suction opening will be larger than the flow velocity of the water that enters the intake duct at the intake opening. By increasing the cross-sectional area at the intake opening with respect to the suction opening, the flow velocity will be much lower at the intake opening and many steam bubbles that move past the intake opening are not sucked into the intake opening, even though the same steam bubbles would be sucked into the suction opening of the outlet duct in case that there was no intake duct arranged at the suction opening of the outlet duct.

The intake duct may exhibit a circular cross-sectional area. It is also possible for the intake duct to exhibit an oval or a polygonal cross-sectional area. The shape of the cross-sectional area may vary along the flow path through the intake duct. The muzzle opening may have a cross-sectional area that matches the cross-sectional area of the suction opening of the outlet duct. However, the muzzle opening may also have a smaller cross-sectional area than the suction opening.

The difference between the cross-sectional areas of the intake opening and the suction opening defines the difference in flow velocity. The flow velocity of the suction flow that flows through the outlet duct will be preset by the suction of the pump during operation of the pump. Thus, it is possible to design the cross-sectional area of the intake opening large enough to prevent an intake of most of the steam bubbles that pass along the intake opening of the intake duct.

According to a further aspect of the invention, the intake duct is mounted on top of the outlet duct and the intake opening is at a distance above of the suction opening of the outlet duct. Thus, the intake opening is above the suction opening and the water that is sucked into the suction opening of the outlet duct must flow downward through the intake duct. During the flow of the water through the intake duct that begins with a small flow velocity, the steam bubbles can escape this flow at low flow velocity and rise upwards and through the intake opening back into the heating chamber.

In accordance with a particularly advantageous embodiment of the invention, the intake duct is funnel-shaped. The funnel-shaped intake duct has several different and beneficial aspects. All steam bubbles that rise from a lower region upwards along the intake duct will be deflected outwards and away from the center of the intake opening to the outer regions of the cross-section of the intake opening with very small flow velocity. Furthermore, the cross-section of the intake opening is much larger than the cross-section of the suction opening resulting in a large difference of flow velocity, i.e. a very small flow velocity at the intake opening of the intake duct. The intake duct may have a continuously decreasing cross-sectional area from the intake opening to the muzzle opening. The cross-sectional area of the muzzle opening can be larger than or preferably identical to the cross-sectional area of the suction opening of the outlet duct. In addition, such a funnel-shaped intake duct facilitates the discharge of water from the heating chamber in case of maintenance or repair operations.

In yet another embodiment of the invention the muzzle opening of the intake duct is located within a sloping bottom surface of the intake duct, whereby a cross-sectional area of the bottom surface of the intake duct is larger than the cross-sectional area of the suction opening of the outlet duct. Such a design of the intake duct will create an advantageous flow distribution along the intake duct and in particular near the muzzle opening that corresponds to the suction opening. The sloping bottom surface also supports the discharge of water.

According to another aspect of the invention, the steam bubble retention device comprises a hat-shaped tubular intake duct that encloses an end region of the outlet duct with the suction opening, wherein an intake opening of the intake duct is located at a distance below the suction opening. Thus, the water that flows through the outlet duct must enter the intake duct at the intake opening that is arranged below the suction opening, which reduces the risk of steam bubbles passing the intake opening and being sucked into the intake duct and subsequently into the outlet duct. The lower the intake opening is positioned, the less will be the number of steam bubbles that can enter into the intake duct. Furthermore, the farther away the intake opening is positioned from the heating element, the less will be the number of the steam bubbles that can enter the into the intake duct.

It is also possible for the intake duct to have a larger cross-sectional area of the intake opening than the suction opening. Thus, both effects are combined, namely the reduced number of steam bubbles due to the lower position of the intake opening and the reduced flow velocity due to the larger cross-sectional area of the intake opening with respect to the suction opening.

The cross-sectional area of the intake duct may be e.g. of circular or oval or polygonal shape. The intake duct may surround the end region of the outlet duct, thereby forming a ring-shaped intake duct cross-sectional area around the outlet duct for the flow of water through the surrounding intake duct into the outlet duct that is arranged along a centerline of the intake duct. It is also possible that the intake duct contacts one side of the outlet duct and forms an intake duct flow path that runs parallel to the outlet duct, whereby the direction of the flow through the intake duct is upwards and the direction of the flow through the outlet duct is downwards.

According to a further aspect of the invention, an upper end of the hat-shaped tubular intake duct comprises a vent hole. Thus, even in case that steam bubbles are sucked into the intake opening of the hat-shaped tubular intake duct, the steam bubbles will be carried towards the upper end of the hat-shaped intake duct and due to the buoyancy, they will accumulate at the upper end of the hat-shaped tubular intake duct. The steam bubbles can then escape the hat-shaped intake duct via the vent hole and rise to the top of the heating chamber. The vent hole should be significantly smaller than the suction opening such that there will be no water or only a very small amount of water sucked through the vent hole into the upper end of the hat-shaped intake duct. The vent hole can be designed in a manner as to support the leakage of steam bubbles into the heating chamber, but to avoid a water flow sucked into the intake duct and into the suction opening through the vent hole. It is possible to arrange several vent holes at the upper end of the hat-shaped intake duct e.g. evenly distanced along an outer circumference of the upper end of the intake duct.

The heating element can be a heating plate that is located within or near the bottom of the heating chamber. It is also possible to make use of a heating coil that is arranged within a lower region of the heating chamber and allows for rapid heating of the water within the heating chamber. In order to further reduce the risk of steam bubbles entering into the intake opening of the intake duct, it is possible that the intake opening of the intake duct is located below the heating element within the heating chamber. Thus, all steam bubbles that will be created during operation of the heating element will rise towards the top of the heating chamber and will not pass along or across the intake opening that is positioned below the heating element. The arrangement of the intake opening below the heating element is not limited to a position of the intake opening directly under the heating element, but comprises any position within the heating chamber at a water level that is lower than the water level at the lowest part of the heating element that generates steam bubbles. Thus, the intake opening can be below the heating element in a vertical direction, but spaced apart from the heating element in a horizontal direction, which will further reduce the risk of any steam bubbles entering the intake opening of the intake duct. In case that the intake opening is located below an upper region of the heating element, it is advantageous to monitor the water filling level within the heating chamber in order to avoid excessive operation of the heating element without sufficient water around the heating element, which might result in overheating of the heating element.

The arrangement of an steam bubble retention device as described above reduces the number of steam bubbles that will be sucked into the outlet duct during a discharge of water through the outlet duct. The removal of water can be caused by gravitational forces only, e.g. if the outlet duct is directed downwards and an outlet opening is arranged lower than the suction opening of the outlet duct.

According to an advantageous embodiment of the invention, the hot water heating device comprises a pumping device, whereby the pumping device is operatively connected to the outlet duct for pumping hot water from the heating chamber through the suction opening into the outlet duct. Thus, discharging water from the heating chamber will be more comfortable for a user. The flow velocity of the water through the outlet duct does only depend on the operation of the pumping device, and does not depend on the height of the water level with respect to the intake opening of the steam bubble retention device. Thus, even If the water level falls close to the intake opening due to the discharge of the water from the heating chamber, the flow velocity will not change due to a change of water pressure at the intake opening.

BRIEF DESCRIPTION OF THE DRAWINGS

The present invention will be more fully understood, and further features will become apparent, when reference is made to the following detailed description and the accompanying drawings. The drawings are merely representative and are not intended to limit the scope of the claims. In fact, those of ordinary skill in the art may appreciate upon reading the following specification and viewing the present drawings that various modifications and variations can be made thereto without deviating from the innovative concepts of the invention. Like parts depicted in the drawings are referred to by the same reference numerals.

DETAILED DESCRIPTION OF THE INVENTION

Figure 1:
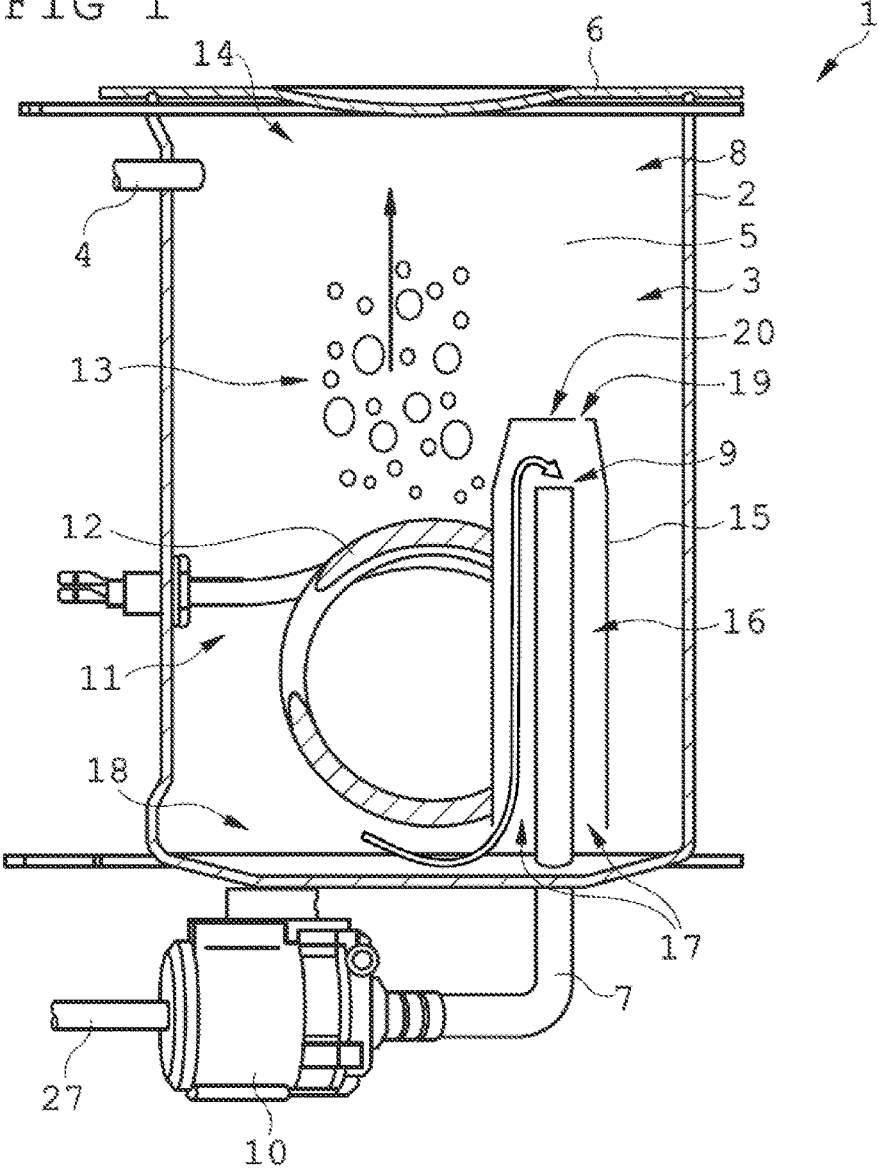
FIG. 1 illustrates a schematic representation of a hot water heating device with an steam bubble retention device, whereby the steam bubble retention device comprises a hat-shaped tubular intake duct that encloses an end region of an outlet duct.

A hot water heating device 1 that is shown in FIGS. 1 and 3 to 5 comprises a housing 2 that encloses a heating chamber 3 of the hot water heating device 1. The hot water heating device comprises an inlet duct 4 for feeding water 5 into the heating chamber 3. The inlet duct 4 can be permanently connected to a water reservoir, e.g. a water supply system within a building. The inlet for water 5 can also be formed by a removable lid 6 or a closable opening in the lid 6 that allows for manual filling of the heating chamber 3 with water. The hot water heating device 1 also comprises a water outlet with an outlet duct 7 that protrudes through the housing 2 into an interior 8 of the heating chamber 3. Water 5 that is removed from within the interior 8 of the heating chamber 3 enters the outlet duct 7 through a suction opening 9 of the outlet duct 7 and then flows through the outlet duct 7 until the water is dispensed from the outlet duct 7. A pumping device 10 is operatively connected to the outlet duct 7. While the pumping device 10 is running, water 5 is sucked from the interior 8 of the heating chamber 3 through the suction opening 9 into the outlet duct 7 and then subsequently delivered by the pumping device 10 from the outlet duct 7 via a withdrawal duct 27 towards a withdrawal device.

The hot water heating device 1 further comprises a heating element 11 with a heating coil 12 that is mounted within the interior 8 of the heating chamber 3. During an operation of the heating element 11, the heating coil 12 gives off heat to the surrounding water 5 within the interior 8 of the heating chamber 3 and heats the water 5 up e.g. to a preset temperature of the water 5 that can be measured by a temperature sensor.

During operation of the heating element 11, the hot heating coil 12 generates steam bubbles 13 within the surrounding water 5. Due to the buoyancy of the steam bubbles 13 within the water 5 they slowly rise to a top 14 of the heating chamber 3, which is indicated by a dashed arrow. Due to the turbulence of the water 5 and the fluctuations of the water 5 within the heating chamber 3, the steam bubbles 13 do not only move vertically upwards, but can also move sideways or even temporarily slightly downwards.

In order to prevent the steam bubbles 13 from being sucked through the suction opening 9 into the outlet duct 7 and subsequently into the pumping device 10, an steam bubble retention device 15 is arranged at the suction opening 9 of the outlet duct 7. The steam bubble retention device 15 shown in FIG. 1 comprises a hat-shaped tubular intake duct 16 that encloses an upper region of the outlet duct 7 with the suction opening 9. The hat-shaped tubular intake duct 16 comprises an intake opening 17 that is located near a bottom 18 of the heating chamber 3 and with respect to a vertical direction at or below a lower part of the heating coil 12. Thus, the water 5 that is sucked into the suction opening 9 must enter the hat-shaped tubular intake duct 16 through the ring-shaped intake opening 17 that is located near the bottom 18 of the heating chamber 3, which will significantly reduce the number of steam bubbles 13 that can be forced into the hat-shaped tubular intake duct 16.

The hat-shaped tubular intake duct 16 comprises a vent hole 19 at a topside 20 of the hat-shaped tubular intake duct 16. In case that an steam bubble 13 enters through the intake opening 17 into the hat-shaped tubular intake duct 16, the steam bubble 13 will move to the topside 20 of the hat-shaped tubular intake duct 16 and can exit the hat-shaped tubular intake duct 16 through the vent hole 19.

Figure 2:
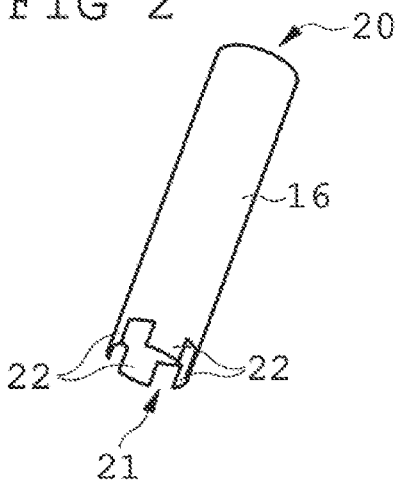
FIG. 2 illustrates a perspective view of an steam bubble retention device similar to the steam bubble retention device shown in FIG. 1.

FIG. 2 illustrates a modified design of the hat-shaped tubular intake duct 16. The topside 20 does not comprise such a tapered section. At an opposite end 21 of the hat-shaped tubular intake duct 16 there are several crenellated protrusions 22 between which water 5 can enter into the hat-shaped tubular intake duct 16 if the hat-shaped tubular intake duct 16 is mounted on the bottom 18 of the heating chamber 3.

Figure 3:
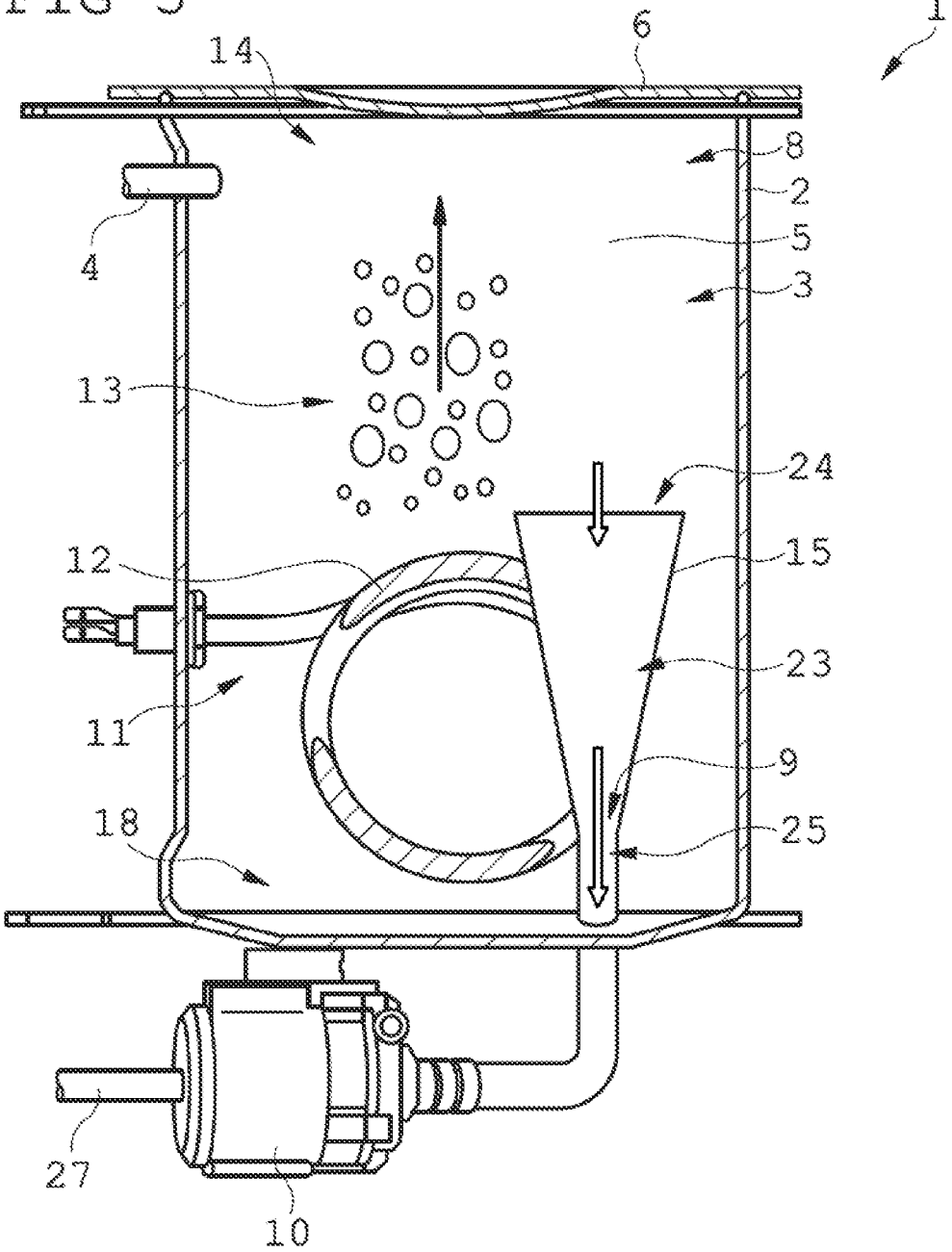
FIG. 3 illustrates a schematic representation of the hot water heating device shown in FIG. 1 with another embodiment of the steam bubble retention device.
Figure 4:
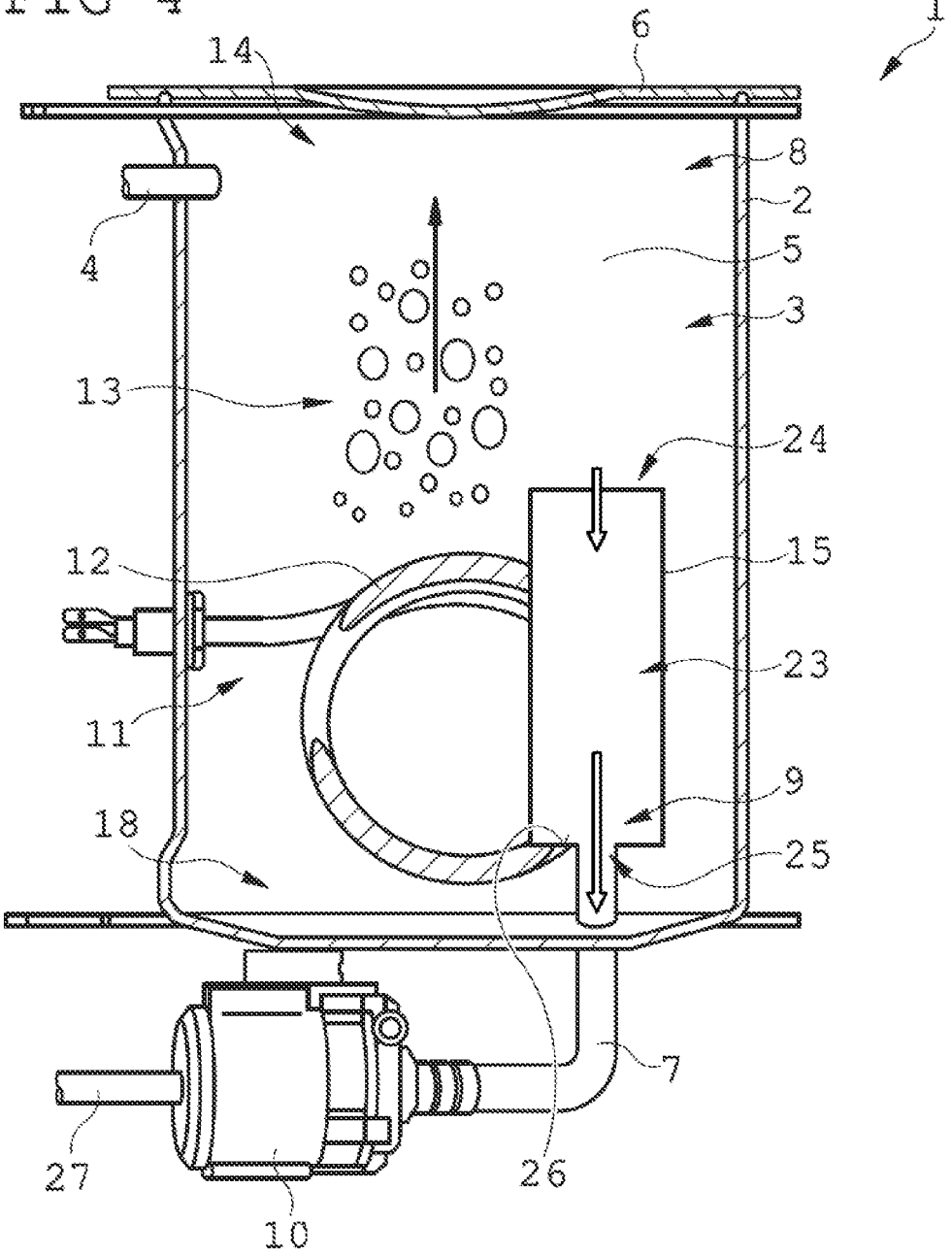
FIG. 4 illustrates a schematic representation of the hot water heating device shown in FIG. 1 with yet another embodiment of the steam bubble retention device.
Figure 5:
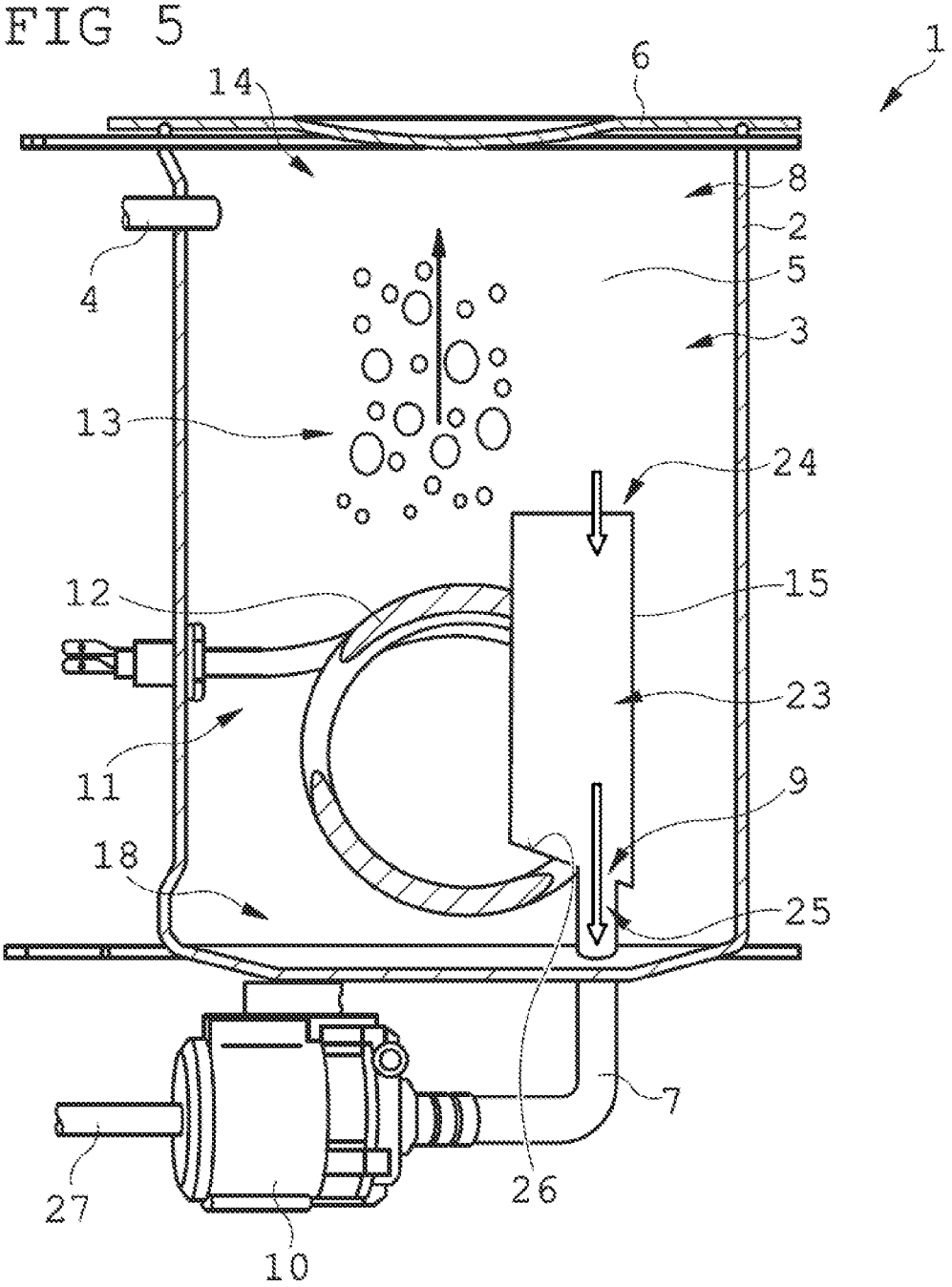
FIG. 5 illustrates a schematic representation of the hot water heating device shown in FIG. 1 with yet another embodiment of the steam bubble retention device.

FIGS. 3 to 5 illustrate schematic representations of the hot water heating device 1 with different embodiments of an intake duct 23 that is attached to the outlet duct 7. In all embodiments, the intake duct 23 comprises a tube-shaped or funnel-shaped section with an intake opening 24 at one end and a muzzle opening 25 at an opposite end, whereby a cross-sectional area of the intake opening 24 is larger than a cross-sectional area of the muzzle opening 25. The intake duct 23 is connected with the outlet duct 7 in a manner such that the muzzle opening 25 is attached to and runs into the suction opening 9 of the outlet duct 7. The intake duct 23 is designed and arranged in a manner such that the intake opening 24 is positioned above the muzzle opening 25, i.e. along a vertical direction higher than the muzzle opening 25. Due to the larger cross-sectional area of the intake opening 24 compared to the muzzle opening 25, the flow velocity of the water 5 that flows from the heating chamber 3 through the intake duct 23 into the outlet duct 7 is considerably smaller at the intake opening 24 compared to the flow velocity of the water 5 at the muzzle opening 25. Thus, the flow velocity that is preset at the suction opening 9 of the outlet duct 7 by the operation of the pumping device 10 is reduced by the intake duct 23 and smaller at the intake opening 24. The dimensions of the intake duct 23 can be preset in a manner as to reduce the flow velocity at the intake opening 24 to a value that is low enough to avoid any intake of the steam bubbles 13 that rise next to the intake duct 23 and pass along the intake opening 24 on their way up to the top 14 of the heating chamber 3.

The intake duct 23 shown in FIG. 3 is funnel-shaped and continually expanding along the direction from the muzzle opening 25 to the intake opening 24.

The intake duct 23 shown in FIG. 4 has a tube-like cylindrical shape with a flat bottom surface 26 that is aligned along a horizontal direction. The muzzle opening 25 is located in a middle of the bottom surface 26. The cross-sectional area of the muzzle opening 25 is smaller than the cross-sectional area of the bottom surface 26. Thus, the flow velocity of water 5 flowing through the intake duct 23 is much slower at the intake opening 23 than at the muzzle opening 25 that is next to and equals the suction opening 9 of the outlet duct 7.

The intake duct 23 shown in FIG. 5 is similar to the intake duct 23 shown in FIG. 4 with the difference of a sloping alignment of the bottom surface 26, whereby the muzzle opening 25 is positioned near a circumferential edge at a lower part of the bottom surface 26. The design and arrangement of the intake duct 23 shown in FIG. 5 supports the escape of steam bubbles 13 that are sucked into the intake duct 23 due to the turbulences and fluctuations of the water 5 in the region above the muzzle opening 25 and also facilitates the discharge of water in case of maintenance or repair operations.

What is claimed is:

1. A hot water heating device, comprising:

a heating chamber with a water inlet for feeding water into the heating chamber and with a water outlet for removing hot water from the heating chamber, whereby the water outlet comprises an outlet duct with a suction opening arranged within the heating chamber at a distance to a bottom of the heating chamber and facing a top side opposite of the bottom of the heating chamber, the hot water heating device further comprising a heating element arranged within the heating chamber for heating the water within the heating chamber, wherein the water outlet further comprises a steam bubble retention device that forms a water intake duct that is directed toward the suction opening of the water outlet and that prevents steam bubbles to flow through the suction opening of the outlet duct, and wherein the steam bubble retention device comprises an intake duct with an intake opening and with a muzzle opening that is directed toward the suction opening of the outlet duct, whereby a cross-sectional area of the intake opening of the intake duct is larger than the cross-sectional area of the suction opening of the outlet duct.

2. The hot water heating device according to claim 1, wherein the intake duct is mounted on top of the outlet duct and that the intake opening is at a distance above of the suction opening of the outlet duct.

3. The hot water heating device according to claim 2, wherein the intake duct is funnel-shaped.

4. The hot water heating device according to claim 3, wherein the steam bubble retention device comprises a hat-shaped tubular intake duct that encloses an end region of the outlet duct with the suction opening, wherein an intake opening of the intake duct is located at a distance below the suction opening.

5. The hot water heating device according to claim 4, wherein the intake opening of the intake duct is located below the heating element within the heating chamber, and wherein an upper end of the intake duct comprises a vent hole.

6. The hot water heating device according to claim 5, wherein a pumping device is operatively connected to the outlet duct for pumping hot water from the heating chamber through the suction opening into the outlet duct.

7. The hot water heating device according to claim 2, wherein the muzzle opening of the intake duct is located within a sloping bottom surface of the intake duct, whereby a cross-sectional area of the bottom surface of the intake duct is larger than the cross-sectional area of the suction opening of the outlet duct.

8. The hot water heating device according to claim 7, wherein the steam bubble retention device comprises a hat-shaped tubular intake duct that encloses an end region of the outlet duct with the suction opening, wherein an intake opening of the intake duct is located at a distance below the suction opening.

9. The hot water heating device according to claim 8, wherein the intake opening of the intake duct is located below the heating element within the heating chamber, and wherein an upper end of the intake duct comprises a vent hole.

10. The hot water heating device according to claim 9, wherein a pumping device is operatively connected to the outlet duct for pumping hot water from the heating chamber through the suction opening into the outlet duct.

11. The hot water heating device according to claim 1, wherein the steam bubble retention device comprises a hat-shaped tubular intake duct that encloses an end region of the outlet duct with the suction opening, wherein an intake opening of the intake duct is located at a distance below the suction opening.

12. The hot water heating device according to claim 11, wherein the intake opening of the intake duct is located below the heating element within the heating chamber.

13. The hot water heating device according to claim 11, wherein an upper end of the intake duct comprises a vent hole.

14. The hot water heating device according to claim 1, wherein a pumping device is operatively connected to the outlet duct for pumping hot water from the heating chamber through the suction opening into the outlet duct.

* * * * *